US006774854B2

(12) United States Patent
Wannagot et al.

(10) Patent No.: US 6,774,854 B2
(45) Date of Patent: Aug. 10, 2004

(54) VARIABLE GAIN AND VARIABLE BEAMWIDTH ANTENNA (THE HINGED ANTENNA)

(75) Inventors: Gary A. Wannagot, Mesa, AZ (US); Angus MacQueen, Chandler, AZ (US); Randall E. Cozzolino, Phoenix, AZ (US); Leslie J. Reading, Spring Valley, CA (US)

(73) Assignee: Galtronics, Ltd., Tiberias (IL)

( * ) Notice: Subject to any disclaimer, the term of this patent is extended or adjusted under 35 U.S.C. 154(b) by 0 days.

(21) Appl. No.: 10/294,449

(22) Filed: Nov. 14, 2002

(65) Prior Publication Data

US 2003/0122714 A1 Jul. 3, 2003

Related U.S. Application Data

(60) Provisional application No. 60/333,809, filed on Nov. 16, 2001.

(51) Int. Cl.[7] ..... H01Q 1/38

(52) U.S. Cl. ..... 343/700 MS; 343/757; 343/872

(58) Field of Search ..... 343/700 MS, 757, 343/872, 848, 878, 893, 702, 846, 883

(56) References Cited

U.S. PATENT DOCUMENTS 4,992,799 A * 2/1991 Garay ..... 343/702
5,966,099 A * 10/1999 Xue ..... 343/702
6,147,649 A * 11/2000 Ivrissimtzis et al. . 343/700 MS
6,239,751 B1 * 5/2001 McRae et al. ..... 343/700 MS

* cited by examiner

*Primary Examiner*—Shih-Chao Chen
(74) *Attorney, Agent, or Firm*—Ladas & Parry

(57) ABSTRACT

A variable gain and variable beamwidth antenna including at least first and second generally planar antenna elements and an antenna element orienter for selectably varying the relative physical orientation of the at least first and second generally planar antenna elements, thereby selectably varying the gain and beamwidth of the antenna.

10 Claims, 5 Drawing Sheets

VARIABLE GAIN AND VARIABLE BEAMWIDTH ANTENNA (THE HINGED ANTENNA)

REFERENCE TO RELATED APPLICATIONS

Reference is hereby made to U.S. Provisional Application Serial No. 60/333,809, filed Nov. 16, 2001 and entitled "Variable Gain and Variable Beamwidth Antenna (The Hinged Antenna)" whose priority is claimed herein.

FIELD OF THE INVENTION

The present invention relates to antennas and more particularly to antennas comprising planar antenna elements.

BACKGROUND OF THE INVENTION

The relevant classification in the U.S. Patent Office is believed to be 343/757. The closest prior art found by applicant is U.S. Pat. No. 5,966,099.

SUMMARY OF THE INVENTION

The present invention seeks to provide an improved antenna having variable gain and variable beamwidth.

There is thus provided in accordance with a preferred embodiment of the present invention a variable gain and variable beamwidth antenna including at least first and second generally planar antenna elements and an antenna element orienter for selectably varying the relative physical orientation of the at least first and second generally planar antenna elements, thereby selectably varying the gain and beamwidth of the antenna.

Preferably, the planar antenna elements include patch antenna elements. Additionally, the patch antenna elements are tuned for 2.45 GHZ having a bandwidth suitable for IEEE 802.11b™ performance.

In accordance with a preferred embodiment of the present invention, the at least first and second planar antenna elements are mounted on respective ground planes. Alternatively or additionally, the at least first and second planar antenna elements are interconnected such that the power of the two antenna elements is summed in phase. Preferably, the at least first and second planar antenna elements are mounted within a radome.

In accordance with another preferred embodiment of the present invention, the at least first and second planar antenna elements are pivotably mounted so that the relative orientation therebetween may be varied. Alternatively, the at least first and second planar antenna elements are pivotably mounted so that the relative orientation therebetween may be varied over a range of at least 60 degrees to 120 degrees. Additionally, the at least first and second planar antenna elements are pivotably mounted about a single axis.

In accordance with another preferred embodiment of the present invention, the antenna element orienter includes a manually adjustable element which is disposed outside a radome and is selectably positionable to vary the relative orientation of the antenna elements.

BRIEF DESCRIPTION OF THE DRAWINGS

The present invention will be understood and appreciated more fully from the following detailed description, taken in conjunction with the drawings in which.

DETAILED DESCRIPTION OF A PREFERRED EMBODIMENT

Figure 1:
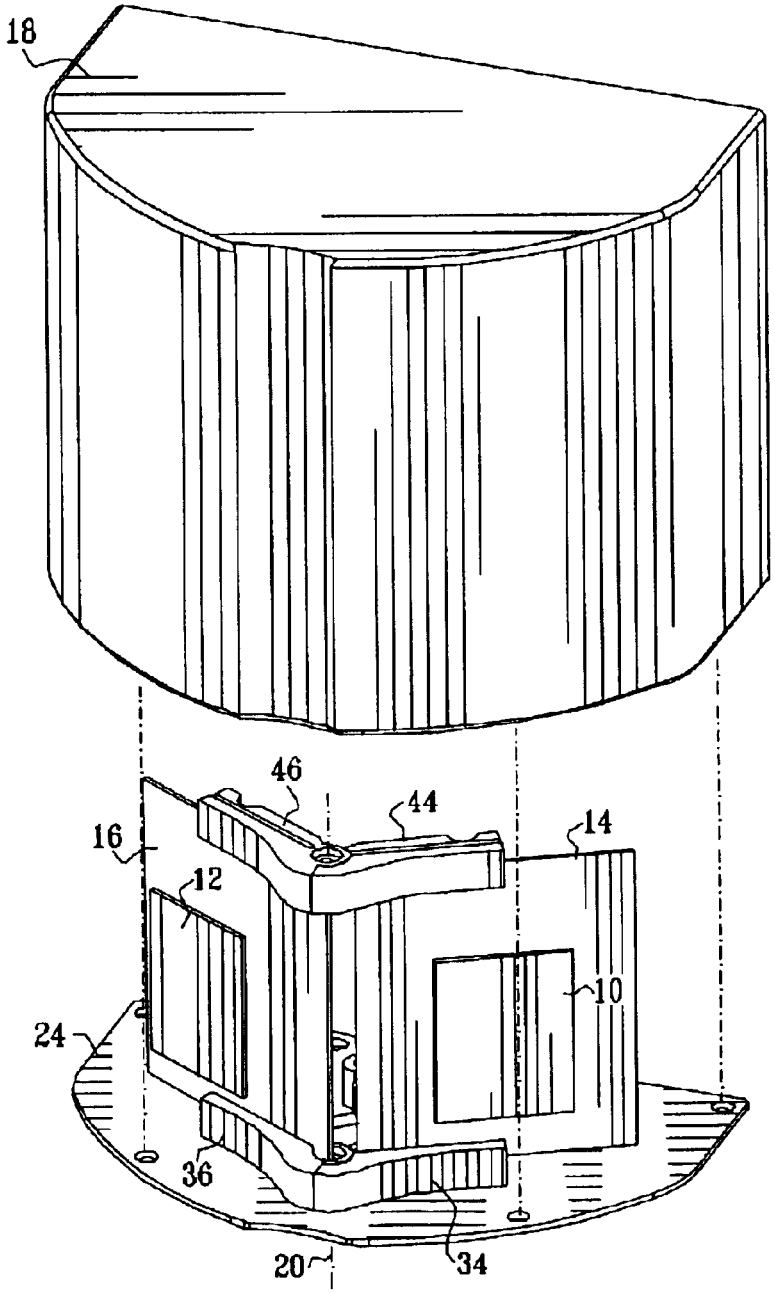
FIG. 1 is a simplified exploded view illustration of an antenna constructed and operative in accordance with a preferred embodiment of the present invention.
Figure 2A:
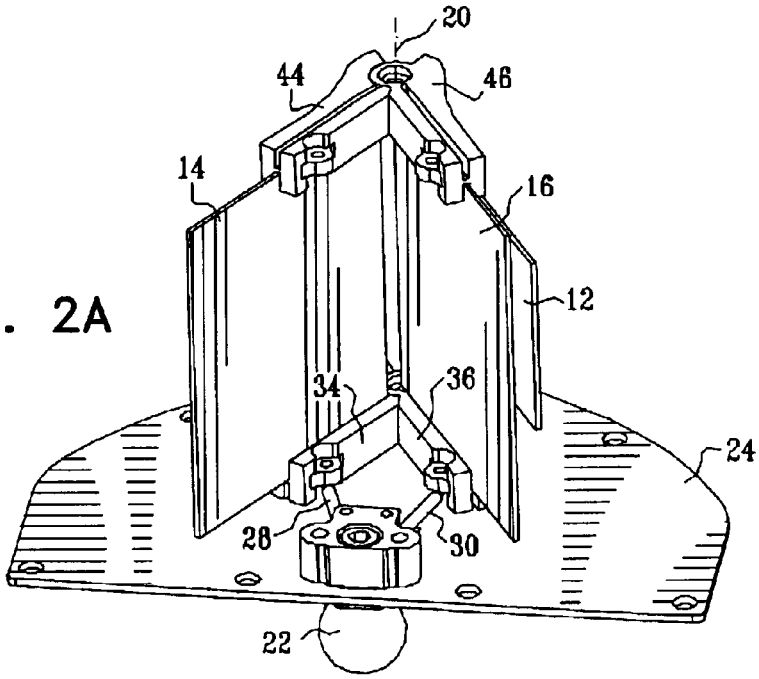
FIGS. 2A and 2B are illustrations of parts of the antenna of FIG. 1 in two different operative orientations selected from a range of possible operative orientations.
Figure 2B:
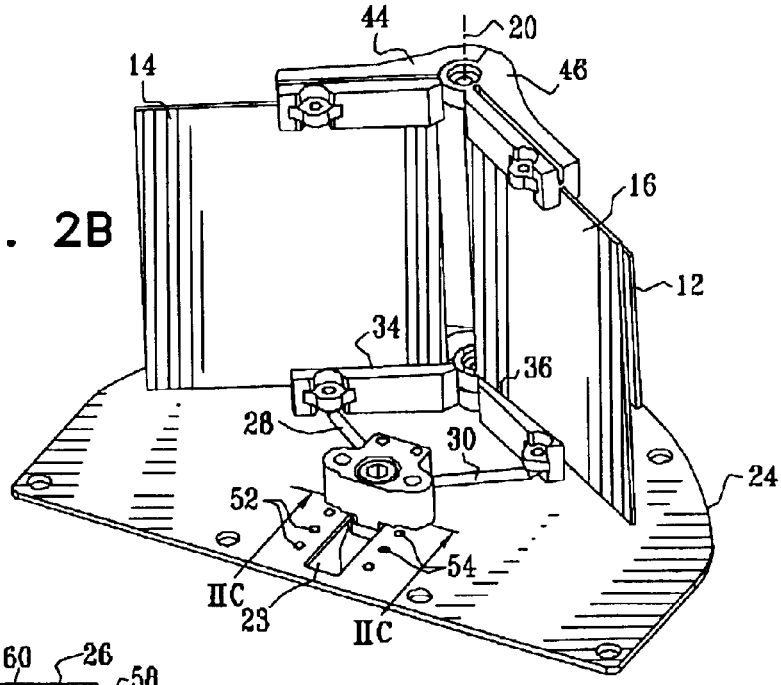
Figure 2C:
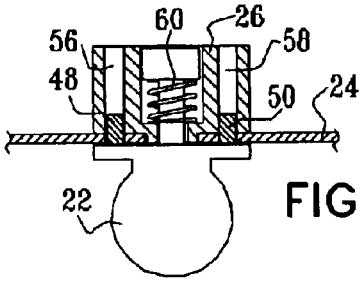
FIG. 2C is a sectional illustration of a manually adjustable knob used in the antenna of FIGS. 1–2B to select different operative orientations from a range of possible operative orientations.

Reference is now made to FIG. 1, which is a simplified exploded view illustration of an antenna constructed and operative in accordance with a preferred embodiment of the present invention, to FIGS. 2A and 2B, which are illustrations of parts of the antenna of FIG. 1 in two different operative orientations selected from a range of possible operative orientations and to FIG. 2C, which is a sectional illustration of a manually adjustable knob used in the antenna of FIGS. 1–2B to select different operative orientations from a range of possible operative orientations.

As seen in FIGS. 1, 2A and 2B, first and second planar antenna elements 10 and 12, preferably patch antenna elements tuned for 2.45 GHZ having a bandwidth suitable for IEEE 802.11b™ performance are mounted on respective groundplanes 14 and 16 and are interconnected in a conventional manner, preferably such that the power of the two antenna elements is summed in phase. The groundplanes are mounted within a radome 18 so as that the relative orientation therebetween may be varied, preferably over the range of 0 degrees to 180 degrees.

Preferably, both ground planes 14 and 16 are pivotable about a single axis, here designated by reference numeral 20. A pivoting mechanism is preferably provided and includes a manually adjustable knob 22 disposed outside radome 18. Knob 22 is slidable along a slot 23 formed in a base plate 24 and is coupled to a pivotal mounting element 26.

A pair of arms 28 and 30 couple the pivotal mounting element 26 to a pair of ground plane supports 34 and 36 which, in turn support respective ground planes 14 and 16. Similar ground plane supports 44 and 46 may be provided at the top of respective ground planes 14 and 16 and may be coupled to similar arms (not shown) which may be coupled to an extension of pivotal mounting element 26 (not shown). It is appreciated that by slidingly positioning the knob 22 at a given position along slot 23, the relative orientation of the antenna elements 10 and 12 may be readily determined. This position may be fixed, as through the use of mounting pins 48 and 50 which may extend from knob 22 through retaining apertures 52 and 54 in base plate 24 and into bores 56 and 58 in pivotal mounting element 26. Knob 26 preferably includes spring 60 to provide for engagement of mounting pins in appropriate apertures 52 and 54 in the base plate 24. It is appreciated that any suitable device may be provided for adjusting ground planes 14 and 16.

FIG. 2A shows the mechanism of FIG. 1 in a 30 degree relative angle position between antenna elements 10 and 12, while FIG. 2B shows the mechanism of FIG. 1 in a 110 degree relative angle position.

Figure 3A:
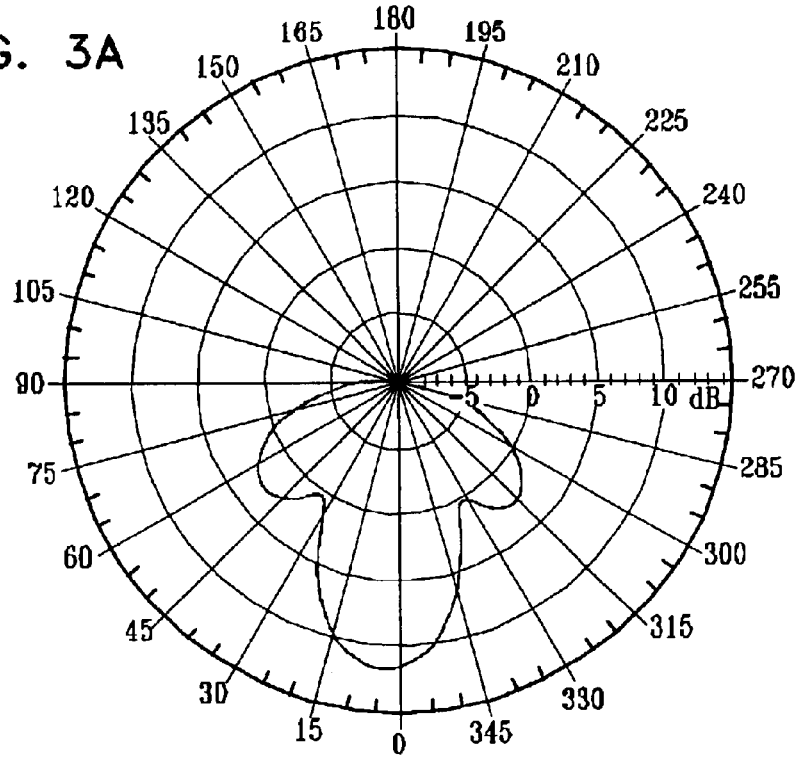
FIGS. 3A, 3B, 3C, 3D, 3E and 3F are illustrations of beam configurations and gain for a variety of different operative orientations of the antenna of FIGS. 1–2B.
Figure 3B:
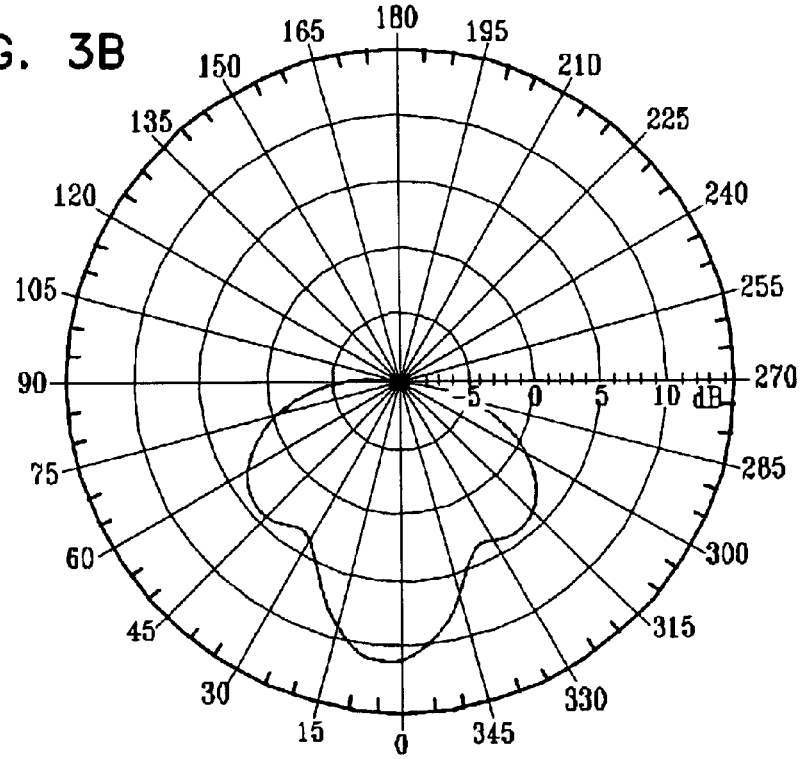
Figure 3C:
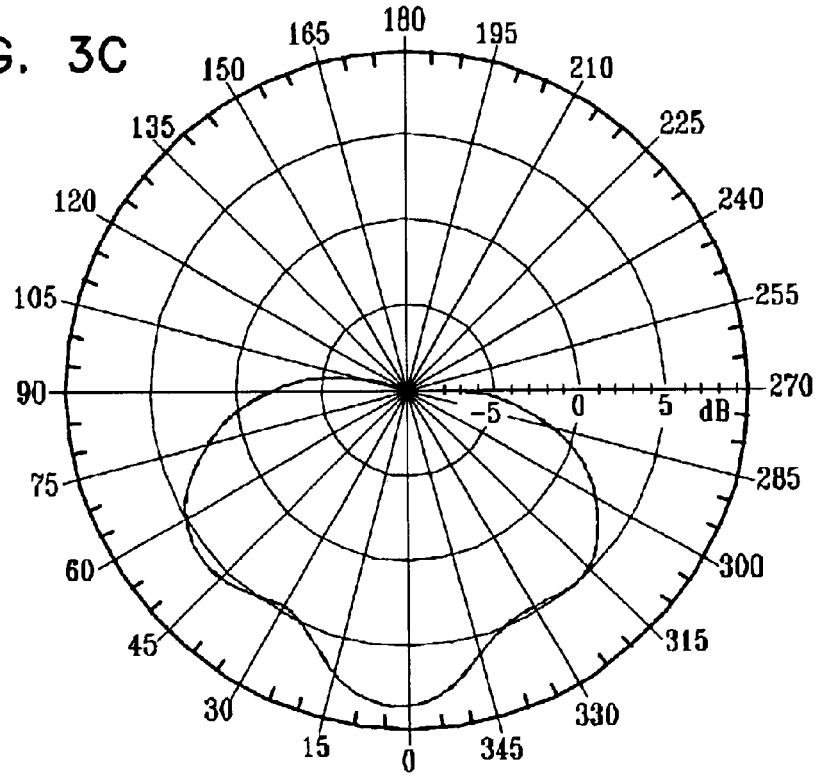
Figure 3D:
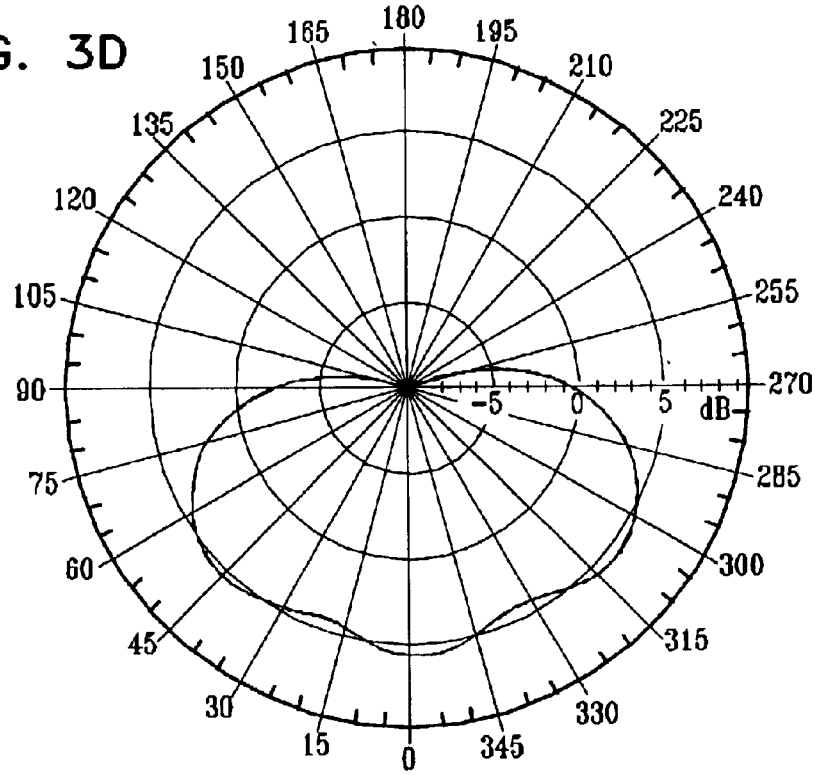
Figure 3E:
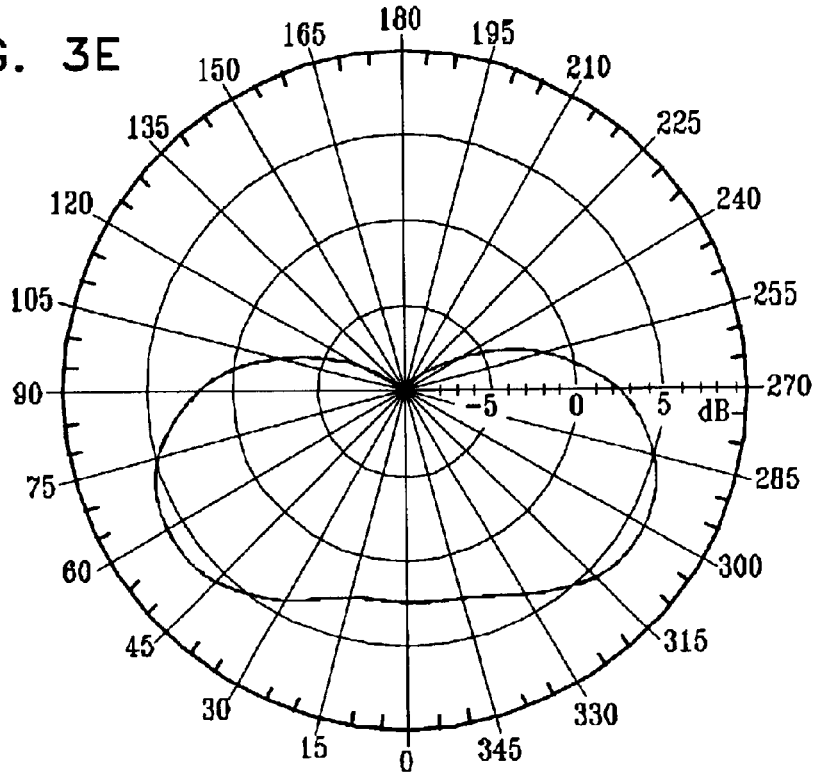
Figure 3F:
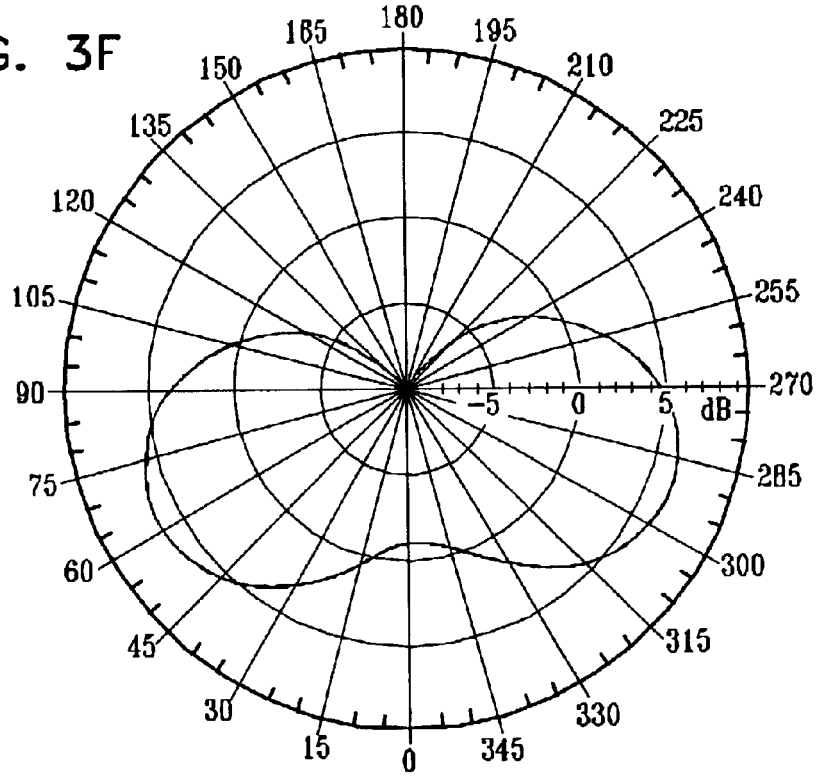

Reference is now made to FIGS. 3A, 3B, 3C, 3D, 3E and 3F, which are illustrations of beam configurations and gain for a variety of different operative orientations of the antenna of FIGS. 1–2B. FIG. 3A shows a beam configuration and gain in which the beamwidth is 30 degrees and the peak gain is 11.8 dBi. FIG. 3B shows a beam configuration and gain in which the beamwidth is 35 degrees and the peak gain is 10.6 dBi. FIG. 3C shows the a beam configuration and gain in which the beamwidth is 45 degrees and the peak gain is 8.4 dBi. FIG. 3D shows a beam configuration and gain in which the beamwidth is 145 degrees and the peak gain is 5.6 dBi. FIG. 3E shows a beam configuration and gain in which the beamwidth is 170 degrees and the peak gain is 6.2 dBi.

It is appreciated that an antenna mechanism of the type described hereinabove may be designed to have a range of angle adjustment between 60 and 120 degrees and have maximum operational versatility.

The antennas of the present invention as described hereinabove have particular value in the context of wireless local area networks, wherein an installer can readily select the beamwidth and gain most appropriate for each antenna installation. Thus an "all-purpose" antenna is thus provided to the installer.

It will be appreciated by persons skilled in the art that the present invention is not limited to what has been particularly shown and described hereinabove. Rather the scope of the present invention includes both combinations and subcombinations of the various features described hereinabove as well as modifications and variations thereof as would occur to a person of skill in the art upon reading the foregoing specification and which are not in the prior art.

What is claimed is:

1. A variable gain and variable beamwidth antenna comprising:

at least first and second generally planar antenna elements lying in respective first and second planes; and a beamwidth and gain selector operative to vary least one of the beamwidth and gain by varying the relative physical orientations of said first and second planes.

2. The variable gain and variable beamwidth antenna according to claim 1 and wherein said planar antenna elements comprise patch antenna elements.

3. The variable gain and variable beamwidth antenna according to claim 2 and wherein said patch antenna elements are tuned for 2.45 GHZ having a bandwidth suitable for IEEE 802.11b™ performance.

4. The variable gain and variable beamwidth antenna according to claim 1 and wherein said at least first and second planar antenna elements are mounted on respective groundplanes.

5. The variable gain and variable beamwidth antenna according to claim 1 and wherein said at least first and second planar antenna elements are interconnected such that the power of the two antenna elements is summed in phase.

6. The variable gain and variable beamwidth antenna according to claim 1 and wherein said at least first and second planar antenna elements are mounted within a radome.

7. The variable gain and variable beamwidth antenna according to claim 1 and wherein said at least first and second planar antenna elements are pivotably mounted to provide a variable relative orientation therebetween.

8. The variable gain and variable beamwidth antenna according to claim 7 and wherein said variable relative orientation therebetween includes a range of at least 60 degrees to 120 degrees.

9. The variable gain and variable beamwidth antenna according to claim 1 and wherein said at least first and second planar antenna elements are pivotably mounted about a single axis.

10. The variable gain and variable beamwidth antenna according to claim 1 and wherein said antenna element orienter comprises a manually adjustable element which is disposed outside a radome and is selectably positionable to vary the relative orientation of said antenna elements.

* * * * *